United States Patent [19]

Stafford

[11] Patent Number: 4,729,321

[45] Date of Patent: Mar. 8, 1988

[54] SHELL HAVING PYRAMID SHAPED SHOT

[76] Inventor: Gilbert A. Stafford, 2600 W. Newton, Tulsa, Okla. 74127

[21] Appl. No.: 66,058

[22] Filed: Jun. 24, 1987

Related U.S. Application Data

[62] Division of Ser. No. 869,317, Jun. 2, 1986, Pat. No. 4,686,904.

[51] Int. Cl.[4] ..... F42B 13/48

[52] U.S. Cl. ..... 102/496; 102/439

[58] Field of Search ..... 102/439, 473, 491–497, 102/506, 389

[56] References Cited

U.S. PATENT DOCUMENTS

| | | | |
|---|---|---|---|
| 29,995 | 9/1860 | Rice | 102/494 |
| 1,240,217 | 9/1917 | Ingram | 102/497 |
| 3,722,414 | 3/1973 | Talley | 102/495 |

*Primary Examiner*—Harold J. Tudor

*Attorney, Agent, or Firm*—Head & Johnson

[57] ABSTRACT

A shell formed of a cylindrical casing having a reduced diameter cylindrical package of explosive contained therein and means to ignite the explosive and a plurality of metallic pellets positioned in the annular area between the explosive and the casing, each pellet being in the form of a polyhedron having a polygonal base and triangular faces meeting in a common apex, the base and all faces being equally dimensioned and shaped.

1 Claim, 4 Drawing Figures

SHELL HAVING PYRAMID SHAPED SHOT

This is a divisional of co-pending application Ser. No. 869,317 entitled "SHELL HAVING PYRAMID SHAPED SHOT" field June 2, 1986, now U.S. Pat. No. 4,686,904.

SUMMARY OF THE INVENTION

A common form of ammunition used for game hunting is a shotgun shell in which the shot is in the form of spherical pellets. The pellets are of metal, usually a lead alloy but sometimes of steel. The shot is packed in the shell with wadding spaced between it and the propellant which typically is in the form of nitrocellotose powder. Spherical pellets, the form of shot pressently used, have the advantage of maximum weight per unit of surface area, however spheroids tend to decelerate rapidly in flight due to air resistance and have little directional stability.

The present invention provides an improved shell, and specifically provides a shell having pyramidal shaped pellets. Such solid triangular pyramidal pellets have four 60° points. In flight with one point forward the three incline planes extending away from the point of the pellet act as fins imparting directional stability. Aerodynamically this point-forward shape is superior to a sphere in overcoming air resistance. Consequently, an increase in range and directional stability, a decrease in drop and greater retention of velocity, energy, and penetration are realized with a pyramidal shape pellet compared to a spherical shape pellet, per given pellet weight.

One means of practicing the invention is in the form of a shotgun shell which includes a casing, a high energy propellant, wadding, and packed pyramidal pellets. At rest within the casing, the pyamidal pellets are in random positions. Upon being forcibly expelled from the muzzle of a gun each pellet is immediately subjected to air pressure. The closest point of each pellet in the line of flight will receive less air pressure than the wider planes to the rear of it and this will cause each of the pellets to be turned and held in a point-on orientation. This point-on orientation results in less air drag or wind resistance than a comparable weight sperical pellet. The reduced wind resistance thereby gives the pellets increased range, less drop, greater energy of impact and therefore improved effectiveness compared to equal weight spherical pellets. Further, pyramidal pellets do not experience the tendency to drift in flight characteristics of spherical pellets. Therefore, less dispersion is experienced providing a more compact and uniform shot pattern.

In case of side winds, air pressure reacting on the pyramidal pellet in flight will produce a directional vectering to compensate for part of the resultant deflection so that a truer flight path is obtained.

While the invention is particularly useful in shotgun shells, pellets of the pyramidal shape will also extend the effective range when used in other shell configurations such as the type particularly applicable to military ordinance wherein the explosive is concentrically contained within a shell casing and the pellets are in the annular area between the exterior of the explosive and the interior of the shell.

A better understanding of the invention will be had by the following specification and claims taken in conjunction with the attached drawings.

DESCRIPTION OF THE PREFERRED EMBODIMENT

Figure 1:
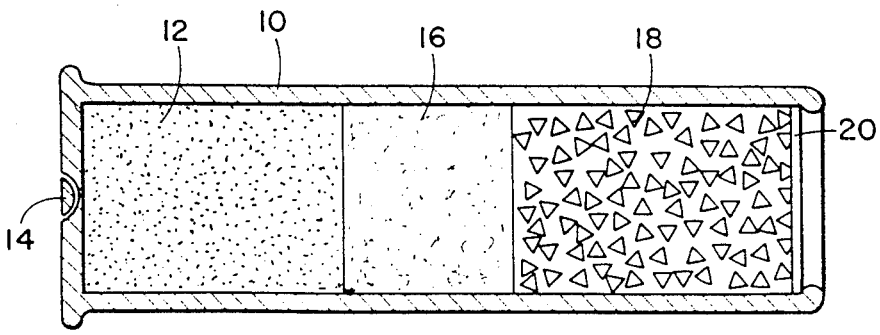
FIG. 1 is a cross-sectional view of a typical shotgun shell showing the use of the pyramidal shaped pellet of the present invention.

Referring to the drawings and first to FIG. 1 a typical shotgun-type shell is shown and includes a casing 10. The casing is shown of uniform material whereas in actual practice it typically has a metal portion at the head with the body formed of paper or plastic. Internally of the casing is an explosive propellant in the form of powder 12. The propellant 12 is ignited by means of a primer 14 which is actuated when physically engaged by a firing pin.

Positioned adjacent the propellant 12 is wadding 16, usually made of jute, felt or other plastic cushioning and obturative material, and adjacent the wadding are pellets 18. The improvement of the shell in this invention is the configuration of the pellets 18, the rest of the shell being of standard construction and the illustration is intended to be merely exemplary of the way a shotgun shell is formed by which the pellets 18 are expelled from a gun barrel at a high velocity. The end of the shell is closed at 20 to retain pellets 18. In some instances closure is accomplished by a light disc made of cardboard-type paper or in other instances the casing 10 is folded to close the end so that when the shell is fired the end merely unfolds so that no end cap or other closure member precedes the pellets out of the barrel.

Figure 2:
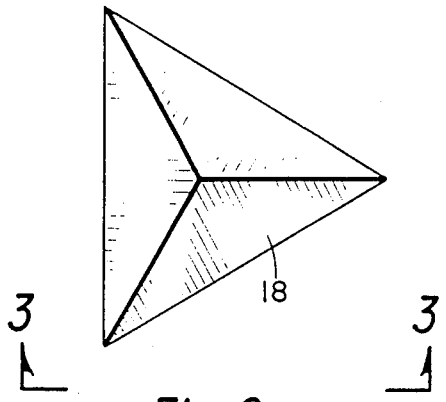
FIG. 2 is an enlarged top view of a pyramidal pellet as employed in the invention.
Figure 3:
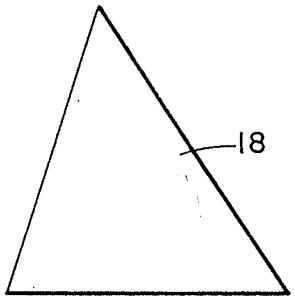
FIG. 3 is an elevational view taken along the line 3—3 of the pyramidal pellet of FIG. 2.

The pellets are formed of metal, such as lead, steel, or an alloy, and the pellets are pyramidal shaped as shown in FIGS. 2 and 3. The particular configuration is that illustrated in which the pyramid is in the form of a polyhedron having a triangular base with triangular faces meeting in a common apex. In the arrangement of each pellet the base is of a size equal to the three sides so that each of the four faces of the pellet is an equilateral triangle.

The size of the pellets can vary as does the size of spherical pellets in shotgun shells in present use. Generally, for longer targets coarser pellets are employed which means fewer pellets within the shell. For smaller targets and/or a broader field, finer and more numerous pellets are employed.

Spherical pellets of the type customarily employed in shotgun shells have the maximum weight per unit of surface area. However, spheroids have a ballistical disadvantage in that as they pass at high velocities through the air they decelerate rapidly from air drag and, being unstable, tend to drift. This tendency to drift causes the spheroid shaped pattern to deteriorate. At distances wherein the shot retains sufficient velocity to be effective, the pattern can disperse sufficiently to cause less shot to hit the target than is necessary even when the gun is properly pointed. Pyramidal pellets as illustrated in FIGS. 2 and 3 have the advantage that they do not tend to drift or wander as they travel through the air and, therefore, shot formed of pyramidal pellets experience substantially less pattern deterioration than do spherical shot.

Solid pyramidal shot formed of pellets each having four equilateral triangles has the unique characteristic that as the shot leaves the muzzle of the gun, the point of each pellet nearest to the direction of flight will align with the flight direction vector. Three of the pyramidal sides extending away from the leading point function as inclined planes, greatly reducing the air resistance of the pellet and serving to retain the pellet in orientation with the leading point imparting directional stability. This aerodynamically stable, point-forward shape achieves an aerodynamic superiority to a sphere and the pellets thereby experience less air resistance. Thus, the pellet will travel at a further distance while retaining an effective penetration impact and with less drop than spherical pellets of comparable weight. Since the pyramidal pellet does not have the tendency to drift that a spheroid pellet has, less scattering takes place so that the shot pattern remains more compact and consistent, providing a longer effective lethal range.

Because of the tendency of spherical pellet patterns to disperse in-flight, gun manufacturers have for many years produced guns with choke barrels, that is, where the internal diameter of the barrel is restricted adjacent the end to cause the shot to compact as it leaves the barrel. This effort to reduce the scatter of spherical shot can still be employed with guns utilizing the pyramidal shot of the present invention, however, the use of chokes will not be as necessary since the pyramidal pellets have substantially less tendency to disperse than spherical shot.

While traditionally shotgun shell pellets have been spherical and have been made of lead, in recent years a strong movement against the use of lead has developed because the ingestion by wild life of lead shot produces leading poisoning. Governmental agencies are experimenting with the proposal to prohibit the use of lead pellets in shotgun shells and requiring, instead, steel shot. Since steel has a density substantially less than lead, the undesirable characteristics of spherical shots when made of steel will be amplified compared to those made of lead. For this reason, the advantage achieved by the use of pyramidal shaped will be even more significant. Stated another way, the decreased air resistance, greater velocity retention and range, and flatter trajectory attainable by pyramidal shot combined with the decreased tendency of pyramdal shot to drift, will be even more significant when government regulations require all shot made of steel.

Figure 4:
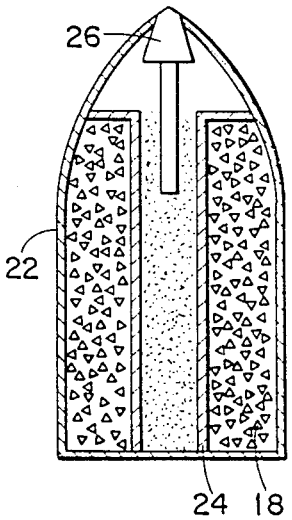
FIG. 4 is a reduced scale cross-sectional view of a type of shell used for military applications in which the pyramidal shot surrounds the explosive within the shell casing.

FIG. 4 shows an alternate means of practicing the invention wherein the casing 22 is cylindrical and has an internal cylindrical explosive propellant cartridge 24, the external diameter of the explosive cartridge being less than the internal diameter of the casing 20 leaving an annular area filled by pyramidal pellets 18. A fuse or detonator 26 is used to ignite the explosive propellant cartridge 24. The fuse may be timed, proximity or impact actuated. The illustration of FIG. 1 and 4 are intended to indicate that the use of the pyramidal pellets of this invention may be employed in order to extend the effective range of any application wherein spheroid-shaped pellet are typically utilized.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A shell comprising:

a cylindrical casing;

an explosive contained within a concentric cylindrical package of reduced external diameter within said cylindrical casing;

means to ignite said explosive; and a plurality of metallic pellets positioned in the annular area between said explosive and said casing, said pellets each being in the form of a polyhedron having a polygonal base and triangular faces meeting in a common apex, the base and all faces being equally dimensioned and shaped.

* * * * *